United States Patent [19]

Richards

[11] 4,040,480

[45] Aug. 9, 1977

[54] STORAGE OF RADIOACTIVE MATERIAL

[75] Inventor: Lawrence M. Richards, Monterey Park, Calif.

[73] Assignee: Atlantic Richfield Company, Los Angeles, Calif.

[21] Appl. No.: 677,188

[22] Filed: Apr. 15, 1976

[51] Int. Cl.[2] ..... E21B 43/00; F28D 15/00; G21F 5/00

[52] U.S. Cl. ..... 166/57; 165/105; 166/305 D; 250/506

[58] Field of Search ..... 166/305 D, 57; 174/15, 174/38; 165/45, 105, 106; 250/506, 518; 122/32

[56] References Cited

U.S. PATENT DOCUMENTS

| | | | |
|---|---|---|---|
| 1,754,314 | 4/1930 | Gay | 174/38 |
| 3,108,439 | 10/1963 | Reynolds et al. | 166/305 D |
| 3,217,791 | 11/1965 | Long | 165/105 |
| 3,472,314 | 10/1969 | Balch | 165/105 |
| 3,828,197 | 8/1974 | Boldt | 250/518 |
| 3,866,424 | 2/1975 | Busey | 165/105 |

*Primary Examiner*—James A. Leppink
*Attorney, Agent, or Firm*—John R. Ewbank

[57] ABSTRACT

Containers of radioactive material are placed in a well, so that the subterranean well lining absorbs much of the radiation from the containers. The heat generated by the radioactive material is transferred through the wall of the container through the wall of a vertically disposed heat tube having a cavity containing both water and water vapor, through the metal wick on the internal wall, and to the liquid water. The thus generated water vapor and/or steam flows upwardly within the cavity of the heat tube into the heat dissipation zone, which is cooled by atmospheric air. Such cooling condenses the steam to liquid water which flows downwardly to the heat absorption zone. The walls of the heat tube have such a low corrosion rate that reliable performance after weathering for many decades is assured.

Some water may be radiolytically decomposed by the radiations from the radioactive material. Canisters of water synthesis catalyst are positioned in the vapor space of the heat tube to recombine the hydrogen and oxygen generated by such radiolytic decomposition of water. The system achieves a maintenance-free arrangement for heat dissipation during a period of decades until the heat generation is low enough to permit cheaper storage, such as in a cavern having subterranean surfaces able to dissipate heat at a rate greater than the radioactive material then generates heat.

4 Claims, 6 Drawing Figures

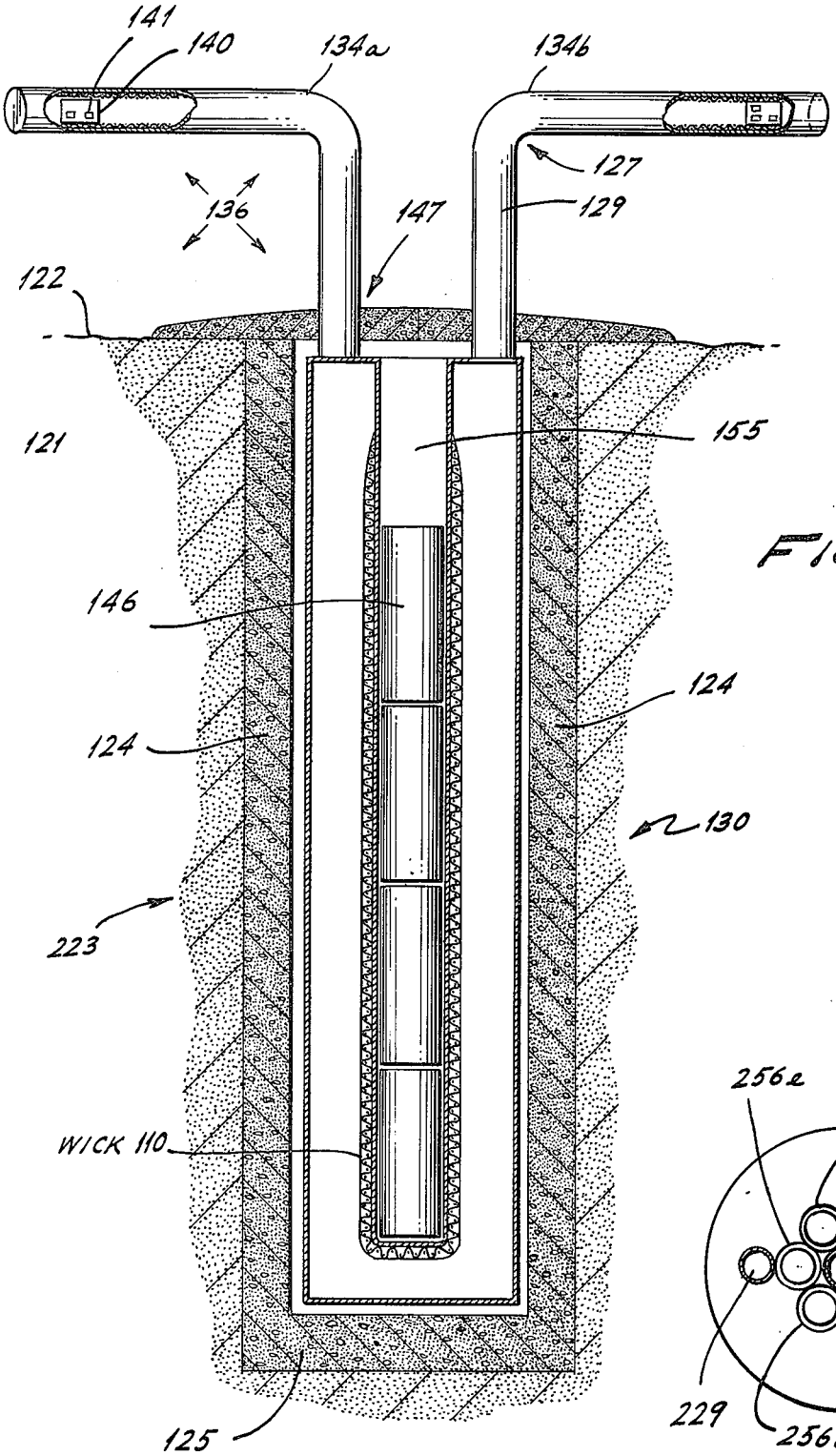
FIG. 4.
FIG. 6.
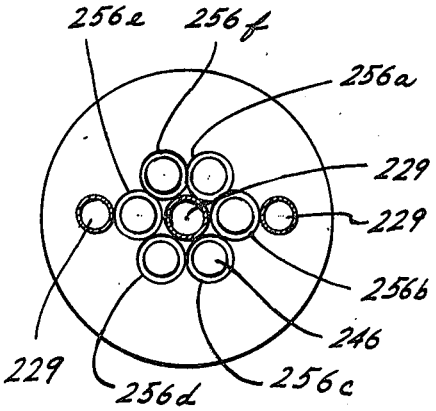

STORAGE OF RADIOACTIVE MATERIAL

FIELD OF INVENTION

This invention relates to the long term storage of depleted fuel or to fission products derived from reprocessing depleted fuel and/or other storage of radioactive materials for achieving dissipation of heat with minimized problems related to the maintenance of the heat dissipation system.

PRIOR ART

Long U.S. Pat. No. 3,217,791 employs a vertical heat tube to transfer arctic atmospheric coldness to maintain the frozen condition of permafrost.

Balch U.S. Pat. No. 3,472,314 employs a vertical tube having internal conduits and baffles adapted to circulate a liquid by thermosiphon action between the upper zone in which heat is radiated to a cold atmosphere and a subterranean zone in which heat is absorbed to keep the subterranean zone almost as cold as the atmosphere. The tube features relatively thin metal because the heat transfer is not dependent upon vaporization and condensation cycles and/or other potentiality of high pressure. Explosion hazards attributable to local weakening of the tube are also minimized by filling substantially all of the tube with a liquid boiling far above the contemplated temperature of the warm zone.

Gay, U.S. Pat. No. 1,754,314 employs a pump to circulate oil between subterranean electrical cables and a heat exchanger. Boiling methanol is refluxed, using the coolness of the atmosphere to condense the methanol in vertical tubes, thereby cooling the oil in said heat exchanger.

Busey, U.S. Pat. No. 3,866,424 employs capsules of radioactive waste to heat liquid sodium and a heat exchanger to generate steam of operate a turbine. In the event of failure of the liquid sodium coolant system, the capsules may fall onto shock absorbers at the bottom of vertical tubes immersed in a pool which is a part of standby coolant system. A pressurized gas minimizes evaporation of the liquid in the tubes under normal conditions but if other coolant systems fail, such tube liquid is evaporated and the vapors are cooled in a higher portion of the tube, some of which is surrounded by a pool of an emergency cooling system, and some of which radiates heat to the atmosphere.

Boldt, U.S. Pat. No. 3,828,197 recommends that a container about 1 foot in diameter and 10 feet long be placed in a cast steel cask having 16 inch walls (about 45 inch diameter by 13 feet long) for storage of radioactive wastes for several decades until the heat dissipation rates is low enough to be tolerable by the subterranean surfaces of a cavern. The thick-walled cask radiates heat to the atmosphere. Said patent clarifies the problems of security, corrosion resistance, and ecological hazards of an area for atmospheric storage of radioactive wastes. However, the cost of 16 inch steel walls for encapsulating radioactive wastes has been high enough that there have been continuing efforts to achieve cheaper but acceptable storage for radioactive materials.

Although there has been a long-standing recognition that heat dissipation systems or cooling systems were needed to cope with the long term storage of radioactive materials, there has been no proposal for a simple low maintenance system for storage of radioactive materials.

SUMMARY OF THE INVENTION

In accordance with the present invention, radioactive materials are packaged in containers and the containers are positioned in a subterranean zone in which a container wall is in good heat transfer relationship with the external wall of a heat tube extending into the storage well. The heat tube contains both water vapor and liquid water. At least in the lower heat absorption zone, and desirably in the upper heat dissipation zone, metal means adjacent the metal walls of the heat tube significantly increases the heat transfer surface. Such metal means is designated as a wick and may consist of a plurality of layers of wire mesh, or sintered open cell porous metal, or other heat conductive high surface area structure increasing the area permitting equilibria between water vapor and flowable film of liquid water. The present invention concerns the transfer of radioactive heat from a subterranean well to the atmosphere by use of a heat tube, and is intended to embrace generically future improvements in heat tubes. The heat generated by the radioactive material flows through the wall of its container and through the wall of the heat tube into the wick water, generating water vapor or steam from the water film on the wick. The steam flows into the heat dissipation zone of the cavity of the heat tube where the water vapor is condensed as the upper arms of the heat tube are cooled by the atmosphere. Desirably, wick aids condensation of the steam. It is possible to expose a large area of the heat tube to the atmosphere, so that whether a wick is employed in the heat dissipation zone may depend in part upon the relative cost of additional tube surface and the cost of wick structures. During a period of storage of several decades, the amount of heat generated by the radioactive material can vary and the atmospheric conditions relating to wind velocity, precipitation, and temperature can vary. Such variations in heat absorption and/or heat dissipation affect the rates of circulation of liquid water and steam within the cavity. The heat tube functions automatically throughout the range of gas velocities and range of gas pressures for which such heat tube was designed.

Radiolytic decomposition of water prompts a mixture of hydrogen and oxygen to flow into the vapor space of the cavity of the heat tube, where such mixture contacts a water synthesis catalyst, thereby being converted back to water vapor. Such water synthesis catalyst prevents the build-up of excessive pressure within the cavity.

DESCRIPTION OF DRAWINGS

In the accompanying drawings,

FIG. 4 is a schematic view of a second embodiment.

FIG. 6 is a top schematic sectional view of the embodiment of FIG. 5.

The invention is further clarified by reference to a plurality of examples.

EXAMPLE 1

Nuclear power is generated in light water moderated nuclear reactors using fuel rods containing from about 2 percent to about 5 percent fissile materials such as $U^{235}$. Depleted fuel rods are sent to a reprocessing plant in which uranium and plutonium and the casing for the rods are recovered for recycling and in which the fission products, non-fissile transuranium elements, and/or other radioactive materials lacking easy marketability, are separated as waste products. The size of the market and the relative cost of separation sometimes affects the "waste" status of a radioactive material. In some cases there is the desire to provide relatively long term storage for the depleted fuel rods after usage in a nuclear reactor but prior to conversion at a reprocessing plant. In other cases, it may be desirable to provide long term storage for radioactive materials having a heat output and/or composition somewhat intermediate between that of depleted fuel and selected waste products from reprocessing.

The radioactive materials, regardless of their type, can be packaged in suitable containers for shipment to the long term storage site. Cylindrical containers having a length of about 15 feet and a diameter from about 1 to about 3 feet would be suitable for some of the radioactive materials selected for the type of intermediate storage contemplated by the present invention.

Figure 1:
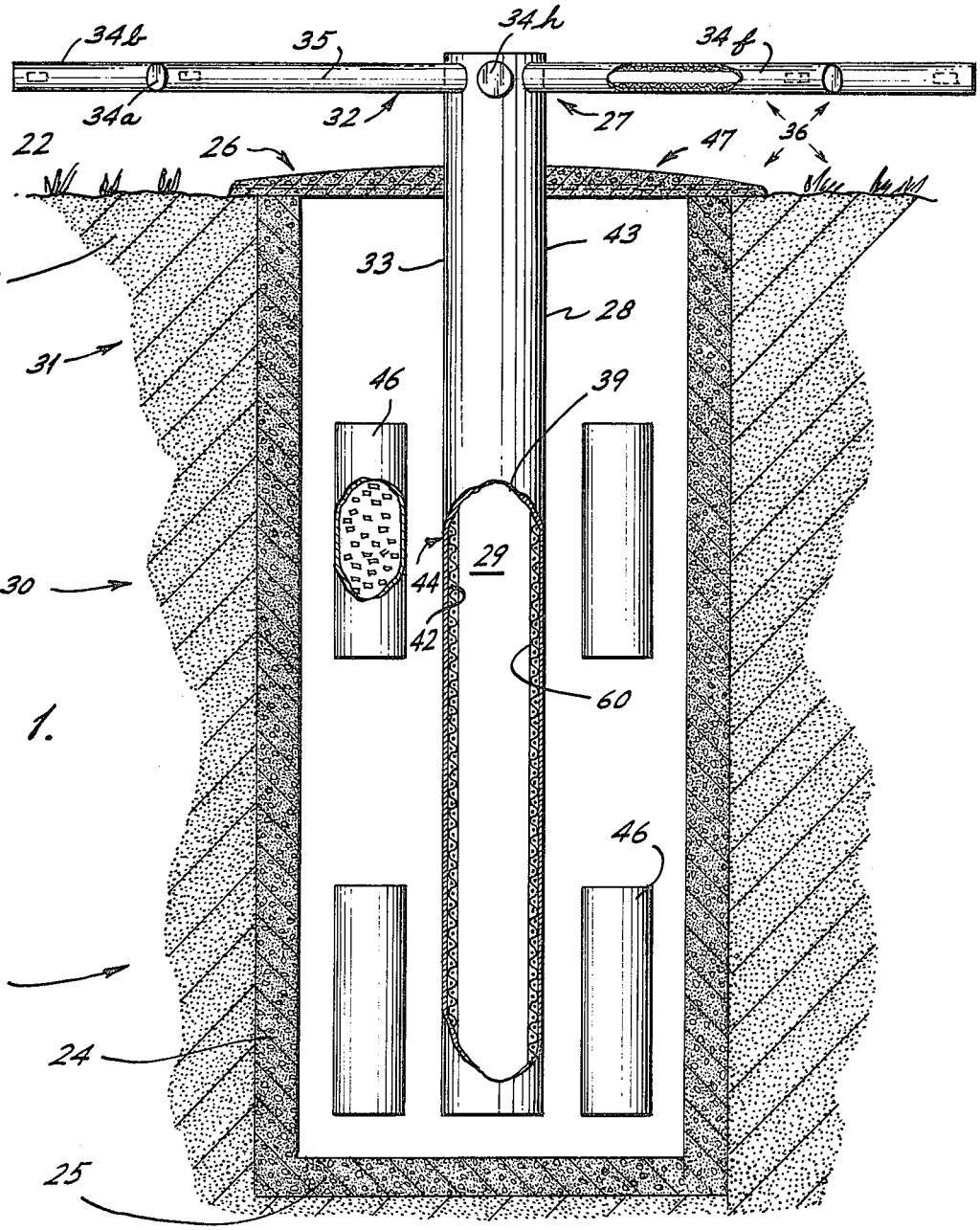
FIG. 1 is a generally schematic view of a first embodiment featuring a central leg of the heat tube.

As shown in FIG. 1, a subterranean portion of the earth 21 extends to a surface 22. A vertical storage well 23 has a lining 24 and a bottom 25. The zone of the well 23 at the earth's surface 22 is designated as a well head 26.

Particular attention is directed to a heat tube 27 having a vertical leg 28 supported by the well bottom 25. Prior art technologists have recognized that a sealed tube having a cavity can serve as a heat transfer device for creating more nearly isothermal conditions in a heat absorption zone and a heat dissipation zone because of circulation within such cavity of vapor and liquid of a controlled quantity of a heat transfer fluid, sometimes called a liquid refrigerant. By controlling the choice of liquid refrigerant in the heat tube and the pressure of normal operation and/or maximum pressure, the temperature of a control zone can be automatically regulated within limits because of the availability of a nearby enviornment accepting heat transfer from the control zone through such a heat tube.

A cavity 29 in heat tube 27 extends through a subterranean heat absorption zone 30 and through an intermediate zone 31 adjacent the well head 26, and into a heat dissipation zone 32. An intermediate portion 33 of heat tube near well head 26 may advantageously be insulated for separating the heat absorption zone 30 from heat dissipation zone 32. A plurality of arms 34*a*, 34*b*, 34*c*, etc. are the atmospherically cooled portions of heat tube 27. External finning of the arms and/or use of wicks along internal walls may decrease the number of arms needed for dissipating to the atmosphere a particular heat load. That portion of cavity 28 which is within the heat dissipation zone 32 is designated as a gas cooling zone 35.

The well 23 is located in a generally isolated area having a long term record of atmosphere conditions suitable for long term storage of radioactive materials and is thus free from typhoons, hurricanes, tornadoes, earthquakes, freezing rains and/or other natural castrophies disruptive to the long term storage of radioactive materials.

Fencing and the like would help to minimize the presence of persons other than the security guards in the area where dozens or hundreds of wells would be protected. The temperature of atmosphere 36 would desirably be within a range from about 35° to about 135° F. so that the atmospheric cooling could appropriately cool the external walls of arms 34*a*, 34*b*, etc. without freezing hazards.

Cavity 29 of heat tube 27 contains both water vapor and liquid water 37 which are both recirculating between the heat absorption zone 30 and heat dissipation zone 32. If the liquid flow patterns are efficiently engineered for maximum wetting of maximum wick, all of the liquid water will be in the wick. Under some engineering situations, there will be liquid water at the bottom of the tube. However, the liquid water level, which can be designated by the optional number 38, is desirably below the frost line for earth 21 and other precautions are taken so that ice formation does not impair operation of the heat tube. Water has a significant advantages over methanol or other freeze-proof refrigerant for cooling radioactive materials. That portion of cavity 29 above liquid level 38 is a vapor zone 39. The radioactive radiation sometimes causes some of water 37 (and/or water vapor) to undergo radiolytic decomposition occasionally to generate a mixture of hydrogen and oxygen, which flows upwardly in the vapor zone 39. Canisters are positioned in gas cooling zone 35 to support particles of water synthesis catalyst 41. To the extend that a mixture of hydrogen and oxygen is generated intermittently by radiolytic decomposition of water, and the water synthesis catalyst promotes the chemical combination of the hydrogen and oxygen even when present in relatively dilute concentrations, thereby forming water vapor, and preserving the substantially pure water vapor content of vapor zone 39. Air carbon dioxide, and other gases are desirably excluded from cavity 29 so that the vapor zone ordinarily contains only water vapor.

Cavity 29 in heat tube 27 is defined by an internal wall 42. A wick 60, such as a few layers of metal mesh or an open pore sintered cellular metal, is desirably a part of at least portions of said internal wall 42. External walls 43 serve to absorb or dissipate heat. Between internal wall 42 and external wall 43 is the thickness 44 of metal heat tube 27. The thickness 44 of heat tube 27 is sufficient to withstand the pressures for which it is engineered, desirably up to about 3200 psig. As long as the atmospheric heat dissipation rate is large enough and as long as the heat tube can consistently cool the radioactive material to about 99° C., the peak pressure can be less than 30 psig, whereby wall thickness 44 can be much thinner, cheaper, and less of a barrier to nearly ideal heat exchange. Of importance is the fact that well thickness 44 is significantly less than the 16 inch thickness for the storage cask of Boldt, U.S. Pat. No. 3,828,197.

Between well lining 24 and external wall 43 of leg 28 of heat tube 27 is an annular zone 45. Containers 46 contain radioactive material. Advantages accrue from controlling the depth of the subterranean well to be about 25 feet to accommodate only a single tier of 15 feet high containers. If land costs are high and the marginal cost of deeper drilling is low, there might be engineering advantages for several tiers of containers, as illustrated in FIG. 1. Several tiers of containers 46 can be stacked in annular zone 45.

At the well head there are access openings permitting containers to be lowered into or out of the storage well. After the containers 46 have been lowered into the annular zone 45 of storage well 23, a closure 47 protects annular zone 45 from precipitation and/or other atmospheric hazards. Several segments 48 combine to achieve such closure 47. One portion of a segment 48 may have a groove 49 adapted to accommodate a tongue 50 of another segment to provide a tongue and groove seal (FIG. 3) between segments 48 at the well head. Such segments are radially shiftable, but each segment is heavy enough to decrease the likelihood of inadvertent or unscheduled opening of the closure means. After assembly, the closure means has characteristics resembling an integral closure.

The closure 47 must be thick enough to serve as a shield protecting the atmosphere from radiation from the containers 46. It is sometimes advantageous to employ a tapered plug structure and/or weld the closure to the well head for decreasing escape of biologically harmful radiation and/or particles from the storage well.

As shown in the enlarged schematic representation of FIG. 4, the wick 60 permits a larger surface area at inner wall 42.

In the practice of the invention using the embodiment of FIGS. 1–4, the storage well 23 is dug and the bottom 25 and lining 24 are secured. Various engineering factors may favor initial placement of the containers followed by placement of the heat tube. In reloading and under other engineering conditions, it might be advantageous to first position the heat tube and then load the containers. The heat tube 27 might thus be lowered into the storage well 23 so that its bottom would rest on the well bottom 25. A series of containers 46 might then be lowered into annular zone 45. Such containers are positioned in heat transfer relationship to the external wall 43 of heat tube 27. After the containers are properly stored, the closure 47 is positioned. Such closure might be formed by radially moving the several segments 48 into the closure position shown in FIG. 1. Thereafter, the radiation emitted by the material in containers 46 is dissipated to a great extend in lining 24 of storage well 23. The heat generated by radioactive material in container 46 heats water 37 because of the heat transfer relationship between the container 46 and external wall 43 of heat tube 27. The vaporization of water from water from wick 60 causes the steam or water vapor to flow into gas cooling zone 35 of arms 34*a,* 34*b,* etc. of heat tube 27. The atmosphere 36 cools the external wall 43 of arms 34*a,* 34*b,* etc., thereby condensing water vapor and causing liquid water to flow back to subterranean portions of the wick 60.

When the heat output of the containers increases, the vapor pressure of steam within cavity 29 can increase; and if the heat output of container 46 decreases, the vapor pressure within cavity 29 and the temperature of cavity 29 can decrease automatically. The heat tube 27 serves to assure the atmospheric cooling of the system throughout a wide range of variation of atmospheric conditions and/or heat output of containers 46.

Figure 2:
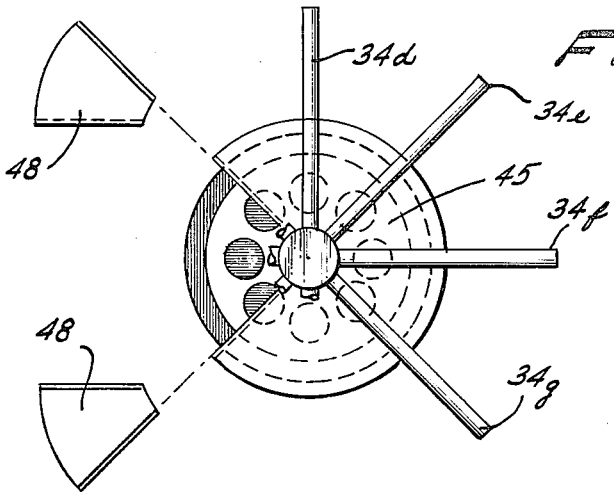
FIG. 2 is a top view of a system for closure of the well head of FIG. 1.
Figure 3:
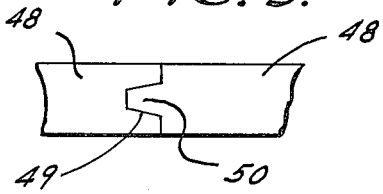
FIG. 3 is a sectional view of a tongue and groove joint between segments of the closure of FIG. 2.

The storage system of FIGS. 1–3 assures trouble-free, zero-maintenance adaption to the varying conditions.

It is desirable to construct the containers 46 to achieve long term encapsulation of any gases generated during storage of the radioactive material. To the extent that there is not gas emission from containers 46, then there need not be any gas emission from well head 26. Some embodiments of the invention provide containers featuring a helium atmosphere, whereby detection of leaks can feature detection of helium. Some embodiments of the invention feature containers having has vents and closures venting gas. A principal problem in the storage of selected type of radioactive materials in achieving a sufficiently foolproof dissipation of heat. The storage system of the present invention has an attractive combination of capital costs and effectiveness.

EXAMPLE 2

As shown in FIG. 4, a vertical well 123 has a lining 124 and bottom 125 analogous to those of FIG. 1. A plurality of arms 134*a,* 134*b,* etc. extend from an upper portion of heat tube 127 and are characterized by water synthesis catalyst 141 in canisters 140. The inner wall 142 of cavity 129 features a wick 160. A storage compartment 155 is in a central portion of heat tube 127. When containers 146 are lowered into storage compartment 155 their cylindrical walls are in heat exchange with the wall of such storage compartment 155. Because the heat transfer embraces a greater proportion of the circumference of the containers 146, the heat tube 127 can dissipate a greater amount of heat from the radioactive material. In other respects, the operation of the system of FIG. 5 resembles that of FIG. 1.

EXAMPLE 3

Figure 5:
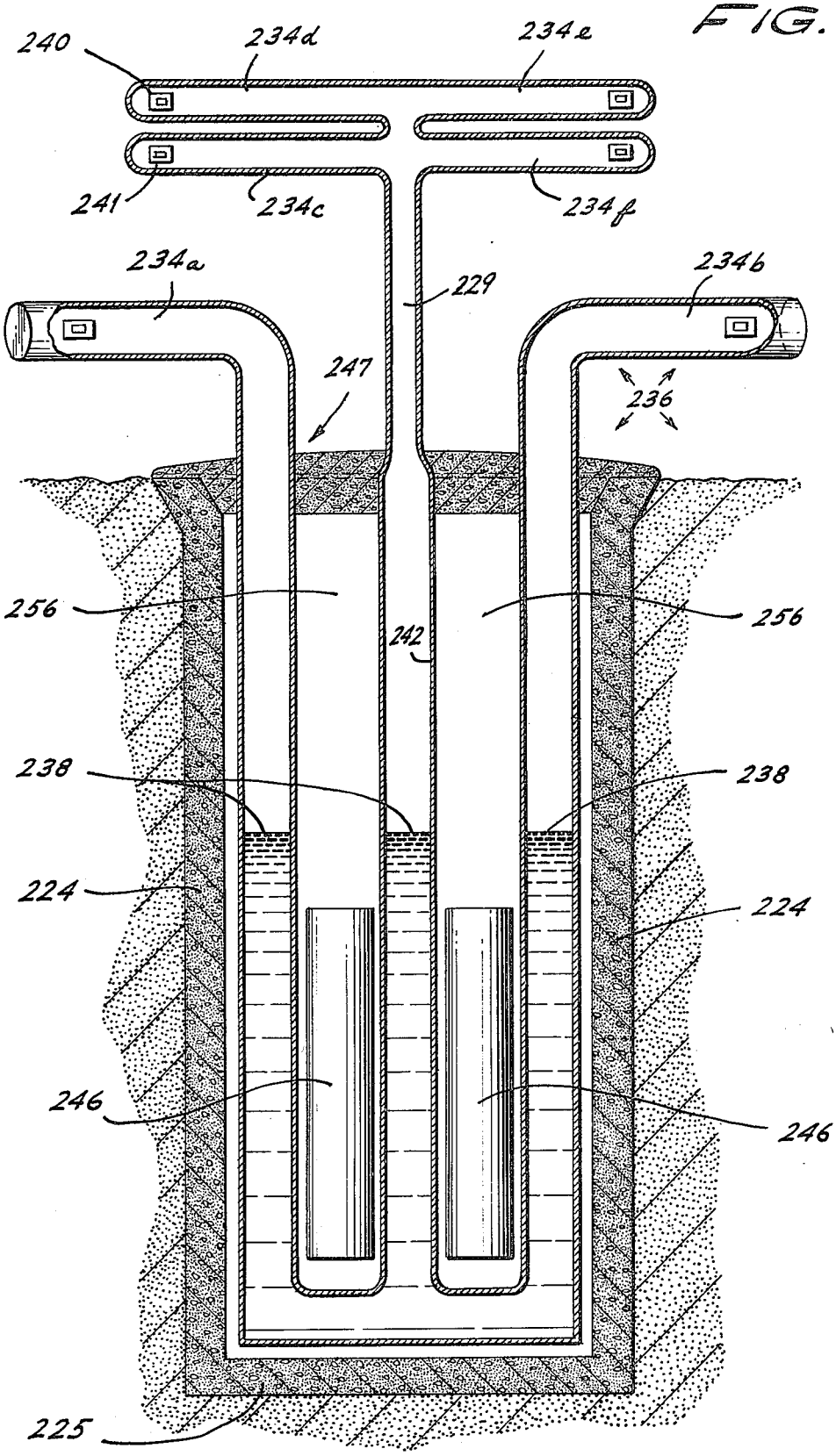
FIG. 5 is a schematic view of a third embodiment.

As shown in FIGS. 5 and 6, a plurality of storage compartments 256*a,* 256*b,* 256*c,* 256*d,* 256*e,* 256*f,* can be positioned in an annular zone 245. In other respects, the operation of the storage system of FIG. 5 resembles that of FIG. 4. The depth of well 223 may be shallow enough to permit storage of only a single tier of containers 246. The internal wall 242 for cavity 229 can be smooth instead of featuring a wick. In the absence of a wick, the heat tube is engineered to maintain a liquid water temperature near 99° C., with a liquid water level 238 well below the closure 247.

Various modifications of the inventions are appropriate without departure from the scope of the appended claims.

I claim:

1. A system for storage of containers for radioactive material, said system consisting essentially of:

a. a lined subterranean well having a vertical axis extending up to a well head at about the earth's surface, there being at said well head, at least one access opening adapted to permit loading of containers into and out of the zone of said subterranean well;

b. a metal heat pipe comprising a vertically oriented heat absorption zone adapted to adsorb heat from said subterranean well, a heat dissipation zone adapted to dissipate heat to the atmosphere, a cavity extending into both the heat absorption zone and the heat dissipation zone, the walls of said heat pipe withstanding the pressure generated within said cavity by delays in heat dissipation from the heat dissipation zone, said cavity having a vapor space containing substantially only water vapor and water being the heat transfer fluid within said heat pipe, each wall of the cavity being an internal wall of said heat pipe;

c. at least one container of radioactive material in heat exchange relationship with said heat tube in the subterranean heat absorption zone;

d. a closure means for the well head of the subterranean well, such closure means having a heavy weight adapted to decrease the likelihood of inadvertent or unscheduled opening of said access openings or shifting of such closure means.

2. A system in accordance with claim 1 in which equilibria between the liquid water and water vapor is promoted by metal wicking at at least portions of the wall of the cavity.

3. A system in accordance with claim 1 in which the closure is thick enough to shield the atmosphere from upward radiation from the containers.

4. A system in accordance with claim 1 in which each container is hermetically sealed to prevent escape of gas from such container.

* * * * *